US008157329B2

(12) United States Patent
Masoud et al.

(10) Patent No.: US 8,157,329 B2
(45) Date of Patent: Apr. 17, 2012

(54) FURNITURE AND METHOD OF FURNITURE COMPONENT ATTACHMENT

(75) Inventors: Khalid Masoud, Souderton, PA (US); Adam Deskevich, Pennsburg, PA (US)

(73) Assignee: Knoll, Inc., East Greenville, PA (US)

( * ) Notice: Subject to any disclaimer, the term of this patent is extended or adjusted under 35 U.S.C. 154(b) by 162 days.

(21) Appl. No.: 12/708,876

(22) Filed: Feb. 19, 2010

(65) Prior Publication Data

US 2010/0213749 A1 Aug. 26, 2010

Related U.S. Application Data

(60) Provisional application No. 61/155,298, filed on Feb. 25, 2009.

(51) Int. Cl.
*A47C 7/02* (2006.01)
*A47C 7/22* (2006.01)

(52) U.S. Cl. ..... 297/452.56; 297/452.13

(58) Field of Classification Search ..... 297/452.56, 297/452.63, 452.13
See application file for complete search history.

(56) References Cited

U.S. PATENT DOCUMENTS

| | | | |
|---|---|---|---|
| 3,233,885 | A | 2/1966 | Propst |
| 3,972,098 | A | 8/1976 | Morrison et al. |
| 4,385,783 | A | 5/1983 | Stephens |
| 4,431,229 | A | 2/1984 | Unger |
| 4,435,882 | A | 3/1984 | Unger |
| 4,465,534 | A | 8/1984 | Zelkowitz |
| 5,035,466 | A | 7/1991 | Mathews et al. |
| 5,297,851 | A | 3/1994 | Van Hekken |
| 5,385,388 | A | 1/1995 | Faiks et al. |
| 5,489,145 | A | 2/1996 | Van Hekken |
| 5,499,413 | A | 3/1996 | Van Hekken |
| 5,791,733 | A | 8/1998 | van Hekken et al. |
| 5,938,285 | A | 8/1999 | Verbeek |
| 6,076,892 | A | 6/2000 | van Hekken et al. |
| 6,367,877 | B1 | 4/2002 | Knoblock et al. |

(Continued)

FOREIGN PATENT DOCUMENTS

WO 2004004518 A1 1/2004

(Continued)

OTHER PUBLICATIONS

PCT—International Search Report and the Written Opinion.

(Continued)

*Primary Examiner* — Rodney B White
(74) *Attorney, Agent, or Firm* — Buchanan Ingersoll & Rooney PC

(57) ABSTRACT

A method of attaching furniture components includes providing a first furniture component that may be comprised of polymeric material, positioning a second furniture component adjacent to the first furniture component, positioning stakes attached to the second component through holes formed in the first component, and heating the stakes to bond portions of the second component to portions of the first component. The second component may also be comprised of polymeric material and the stakes may be integral with the second component or formed on the second component. Chairs or other furniture such as office furniture may include components attached together by embodiments of the disclosed method. In some embodiments of the method, a second component may also have projections that are positioned through holes in a third furniture component that may subsequently be heated to bond the third component to the second component.

9 Claims, 8 Drawing Sheets

U.S. PATENT DOCUMENTS

| | | | | |
|---|---|---|---|---|
| 6,386,634 | B1 | 5/2002 | Stumpf et al. | |
| 6,439,665 | B1 | 8/2002 | Cvek | |
| 6,540,950 | B1 | 4/2003 | Coffield | |
| 6,669,292 | B2 | 12/2003 | Koepke et al. | |
| 6,702,390 | B2 * | 3/2004 | Stumpf et al. | 297/452.56 |
| 6,722,741 | B2 * | 4/2004 | Stumpf et al. | 297/452.56 X |
| 6,726,285 | B2 | 4/2004 | Caruso et al. | |
| 6,733,080 | B2 | 5/2004 | Stumpf et al. | |
| 6,802,566 | B2 | 10/2004 | Prince et al. | |
| 6,817,667 | B2 | 11/2004 | Pennington et al. | |
| 6,863,348 | B1 | 3/2005 | Cvek | |
| 6,899,398 | B2 * | 5/2005 | Coffield | 297/452.56 |
| 6,915,315 | B2 | 7/2005 | Autrey et al. | |
| 6,957,863 | B2 | 10/2005 | Heidmann et al. | |
| 6,966,606 | B2 * | 11/2005 | Coffield | 297/452.56 |
| 6,983,997 | B2 * | 1/2006 | Wilkerson et al. | 297/452.56 |
| 7,100,885 | B2 | 9/2006 | Zerner | |
| 7,270,378 | B2 * | 9/2007 | Wilkerson et al. | 297/452.56 |
| 7,419,222 | B2 | 9/2008 | Schmitz et al. | |
| 7,594,700 | B2 * | 9/2009 | Stumpf et al. | 297/452.56 |
| 7,794,022 | B2 * | 9/2010 | Caruso et al. | 297/452.56 |
| 2003/0071509 | A1 | 4/2003 | Neil et al. | |
| 2003/0168901 | A1 * | 9/2003 | Wilkerson et al. | 297/452.56 |
| 2006/0006715 | A1 | 1/2006 | Chadwick et al. | |
| 2011/0025109 | A1 * | 2/2011 | Ryczek et al. | 297/452.56 X |

FOREIGN PATENT DOCUMENTS

| | | | |
|---|---|---|---|
| WO | 2005020762 | A1 | 3/2005 |
| WO | 2006094258 | A2 | 9/2006 |
| WO | 2008041868 | A3 | 4/2008 |

OTHER PUBLICATIONS

International Preliminary Report on Patentability for PCT/US2010/025009, dated Aug. 30, 2011 (6 pages).

* cited by examiner

FURNITURE AND METHOD OF FURNITURE COMPONENT ATTACHMENT

CROSS REFERENCE TO RELATED APPLICATION

The present application claims priority to U.S. Provisional Patent Application Ser. No. 61/155,298, filed on Feb. 25, 2009. The entirety of U.S. Provisional Patent Application Ser. No. 61/155,298 is incorporated herein by reference.

FIELD OF THE INVENTION

The invention relates to articles of furniture, such as chairs and methods of attaching furniture components.

BACKGROUND OF THE INVENTION

Chair components are often attached together by fastening mechanisms. Some fastening mechanisms, such as screws or bolts, often include portions that are visible to a seated user or a potential customer. For example, the head of a screw or bolt may be positioned along an outer portion of a frame member of a chair that can be seen by a user or potential customer. Such visible elements may detract from the aesthetic effect provided by a chair or article of furniture Some chair components may be attached together by overmolding one component onto another component. Such molding may occur using injection molding mechanisms and require separate shots, or molding steps for molding the first component and then molding the second component onto the first component. Alternatively, a structure may be purchased from a supplier and a component may subsequently be overmolded onto that structure. The use of such overmolding often requires significant expense in the purchasing of one or more molds. Further, overmolding may only be utilized for certain components that meet particular structural requirements or that are only accessible at a select few steps in a chair manufacturing process, which may limit assembly options and increase the costs of manufacturing an article of furniture, such as a chair.

A new method of attaching furniture components is needed. Preferably, the new method provides design flexibility, assembly processing design flexibility, and permits components to be attached without the attachment negatively impacting the aesthetic effect provided by the furniture assembled in accordance with that method.

SUMMARY OF THE INVENTION

A method of attaching furniture components, such as chair components is provided. One method includes positioning a back skin adjacent to a back frame, folding side portions of the back skin over the back frame, positioning a cross member between the folded over side portions of the back skin, positioning stakes formed in the cross member or projecting from the cross member through holes formed in the folded over side portions of the back skin, and heating the stakes to bond portions of the cross member to portions of the back skin. The back skin and cross member are preferably comprised of polymeric material.

Embodiments of the method may also include positioning projections formed in the cross member into openings formed in the back frame for attaching portions of the cross member to the back frame. The projections may then be heated to attach the cross member to the back frame.

The heating of the projections may be provided by infrared light energy or infrared radiation. The heating of the stakes may also be provided by infrared light energy or infrared radiation.

The back skin may define apertures that are longitudinally elongated. Of course, the back skin may also not include holes or apertures, may be have a mesh structure, or may include holes or apertures of other shapes or configurations. For instance, the back skin may alternatively have uniform holes or have holes of different configurations, such as square holes and elliptical holes. As another example, the holes in the back skin may be elongated laterally.

Another method for attaching furniture components includes providing a first furniture component comprised of polymeric material, positioning a second furniture component adjacent to the first furniture component, positioning stakes attached to the second furniture component through holes formed in the first furniture component, and heating the stakes to bond portions of the second furniture component to portions of the first furniture component.

The second furniture component may also be comprised of polymeric material. The polymeric material of the second furniture component may be the same material as the material of the first furniture component or may be a material that is different than the material of the first furniture component. The first furniture component may be comprised of material that is harder than the material of the second furniture component. The material of the first furniture component and the material of the second furniture component are preferably materials such as plastics or elastomeric materials.

The first furniture component may be a unitary structure or may be formed by attaching a plurality of structures together. The second component may also be a unitary structure or may be formed by attaching a plurality of structures together.

It should be understood that the first furniture component may be comprised of a polymeric material and have a durometer measurement of not greater than 40 and the second furniture component may also be comprised of a polymeric material that have a durometer measurement of not greater than 40. The first furniture component may be a back frame component, a seat frame component, an arm pad component, an arm pad support component, a back skin component, a seat skin component, an arm pad covering component, or other structural components used in chairs or other furniture. The second furniture component may be a back frame component, a seat frame component, an arm pad component, an arm pad support component, a back skin component, a seat skin component, an arm pad covering component, or other structural components used in chairs or other furniture.

A chair is also provided. The chair may include a base, a frame connected to the base, a skin adjacent to the frame and a first member attached to a portion of the frame by insertion of a first set of projections within apertures formed in the frame and then heating the first set of projections via infrared energy to bond the first member to the frame. The infrared energy may be, for example, infrared radiation or infrared light energy.

The first member may be a component of the frame for a chair component such as a seat frame or back frame. The first member may alternatively be another component.

It should be appreciated that the base may have numerous different configurations. For instance, the base may include a seat supported on a pedestal or may include a tilt mechanism positioned between a seat and a pedestal.

In some embodiments, the first member may include a second set of projections and the skin may be attached to the first member by an application of infrared energy to the second set of projections to bond the skin to the first member. The second set of projections may be inserted through holes defined in the skin prior to the application of the infrared energy applied to the second set of projections to bond the skin to the first member.

Preferably, the frame is comprised of a material that is harder than the skin. The first member may be comprised of a material that is harder than the skin, softer than the skin, or having the same hardness as the skin.

Preferably, the first member is a cross member. It is contemplated that the first member may alternatively be configured for positioning between a frame element and a skin element for connecting the frame element to the skin element.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of furniture, such as chairs and present preferred methods of furniture component attachment are shown in the accompanying drawings.

DETAILED DESCRIPTION OF PRESENT PREFERRED EMBODIMENTS

Figure 1:
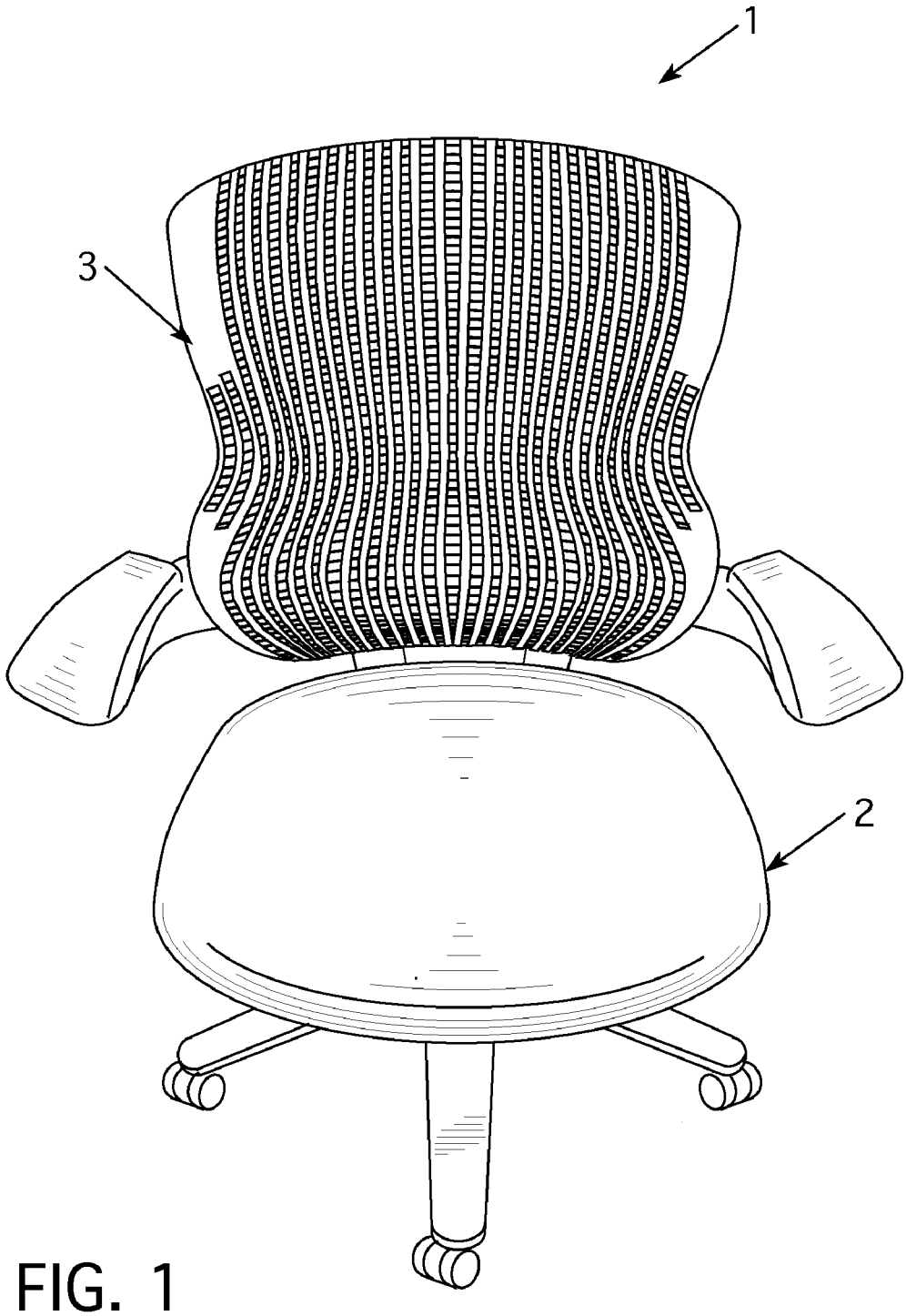
FIG. 1 is a front perspective view of a first present preferred embodiment of a chair.
Figure 2:
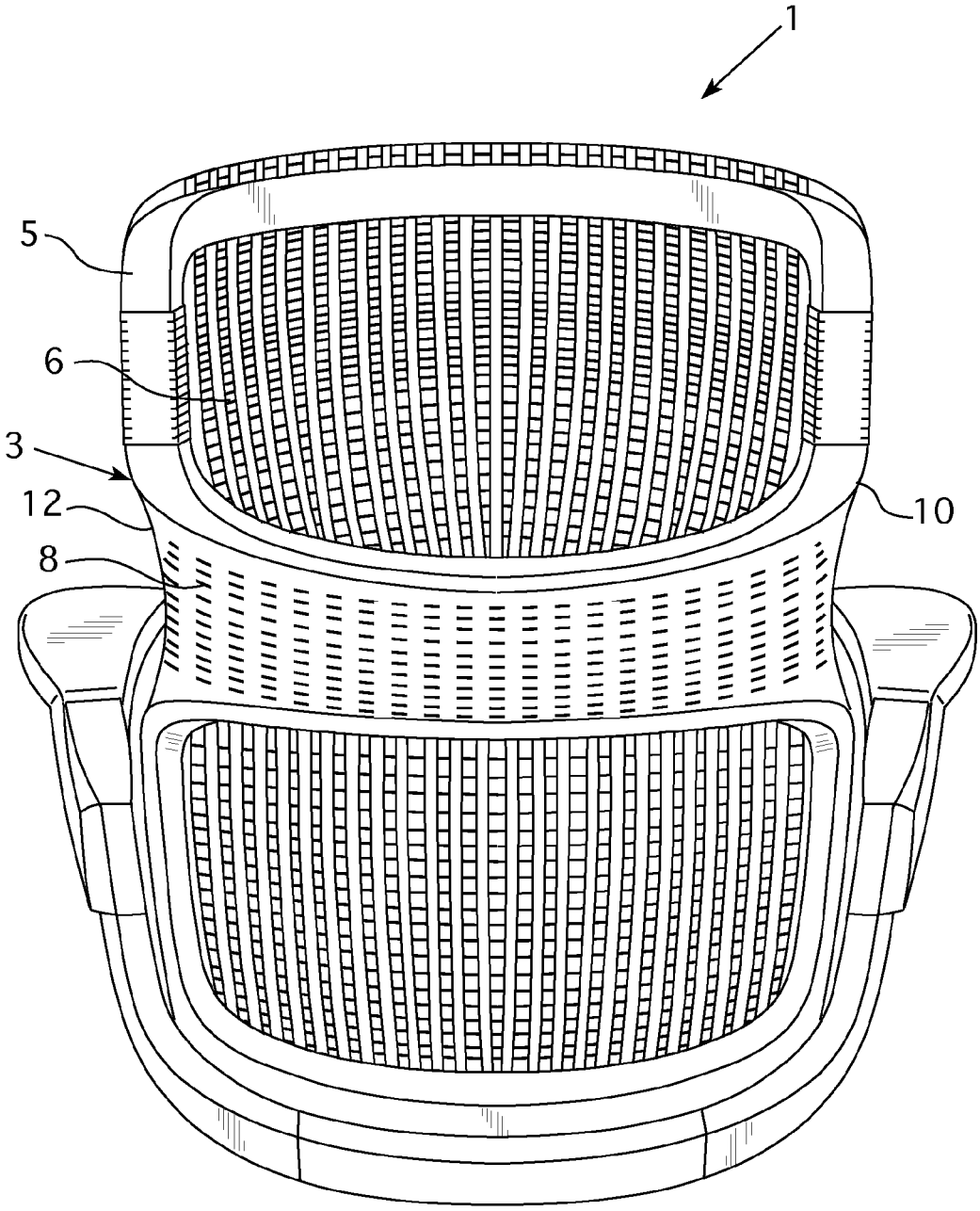
FIG. 2 is a rear perspective view of the first present preferred embodiment of the chair.

Referring to FIGS. 1-2 a first present preferred embodiment of a chair 1 has a seat 2 and a back 3. The back 3 of the chair 1 includes a back frame 5. The back frame 5 is attached to the base of the chair and is moveable relative to the seat 2 such that the back 3 can recline. For instance, the back frame 5 may be attached to a control mechanism to provide such recline movement. Preferably, the seat 2 is attached to the base of the chair such that the seat 2 is raised when the back 3 is reclined. The chair 1 may have armrests that are adjustably attached to the base of the chair or the back frame 5 of the chair.

Figure 8:
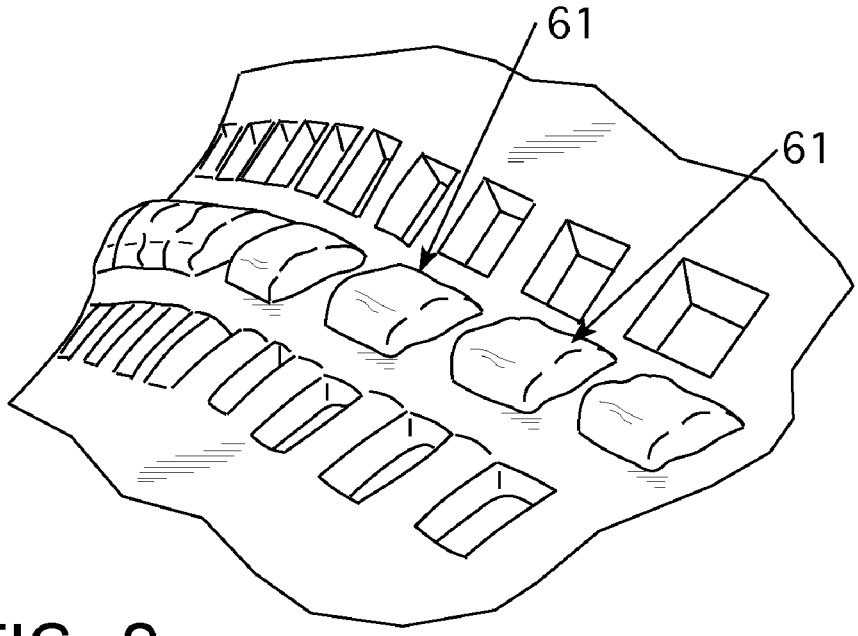
FIG. 8 is a fragmentary view of a portion of the first present preferred chair back component and a portion of the second present preferred chair back component attached to each other.

The back frame 5 preferably has a "FIG. 8" configuration defined by an upper first hoop attached to a lower second hoop by a central post. The back frame 5 is preferably composed of plastic or an elastomeric material. A back skin 6 is attached to the back frame 5. The back skin is preferably an elastomeric sheet of material with holes formed therein. Preferably, the holes in of the back skin are elongated longitudinally. A lumbar support may also be attached to the back frame 5. The back skin 6 has a first side 10 and a second side 12 opposite the first side 10. The first side 10 and second side 12 extend from the top of the back skin to the bottom of the back skin. The back 3 also includes a bow tie 8 attached to the back frame. The bow tie 8 may be a cross member that can provide a desired aesthetic effect to the back 3 of the chair 1.

Figure 3:
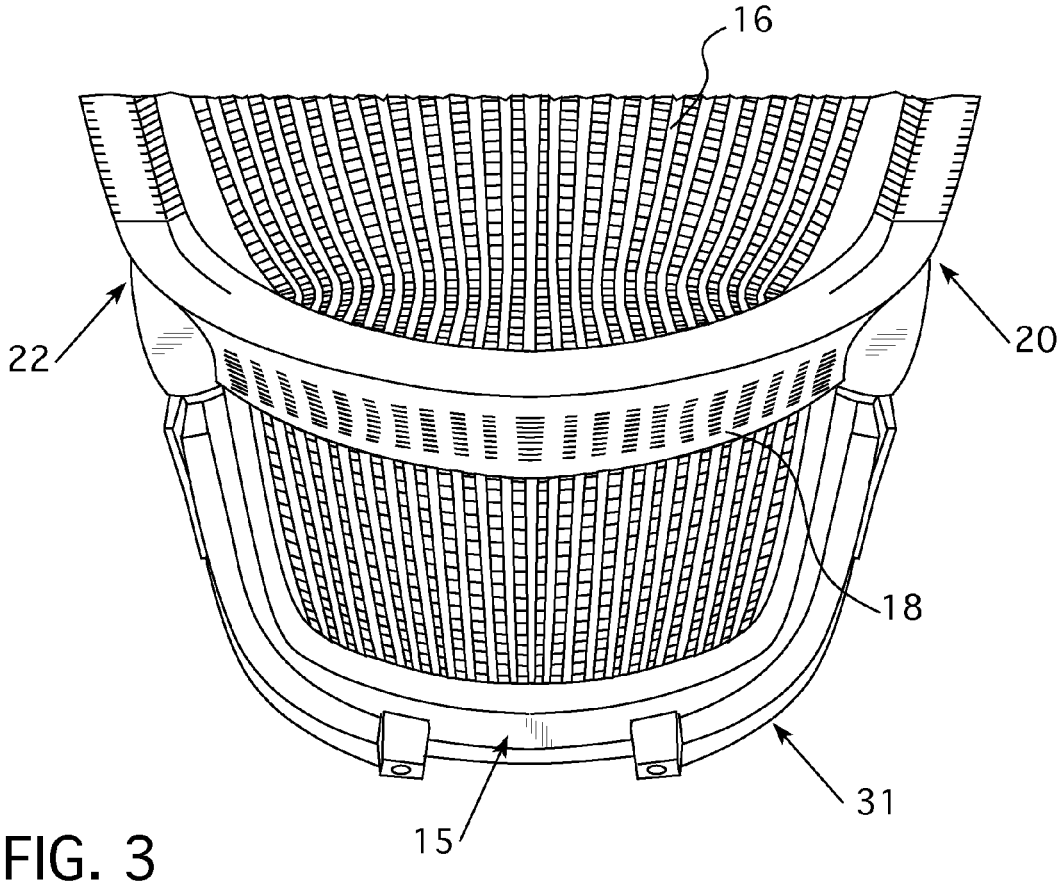
FIG. 3 is a rear perspective view of a second present preferred embodiment of a chair.
Figure 4:
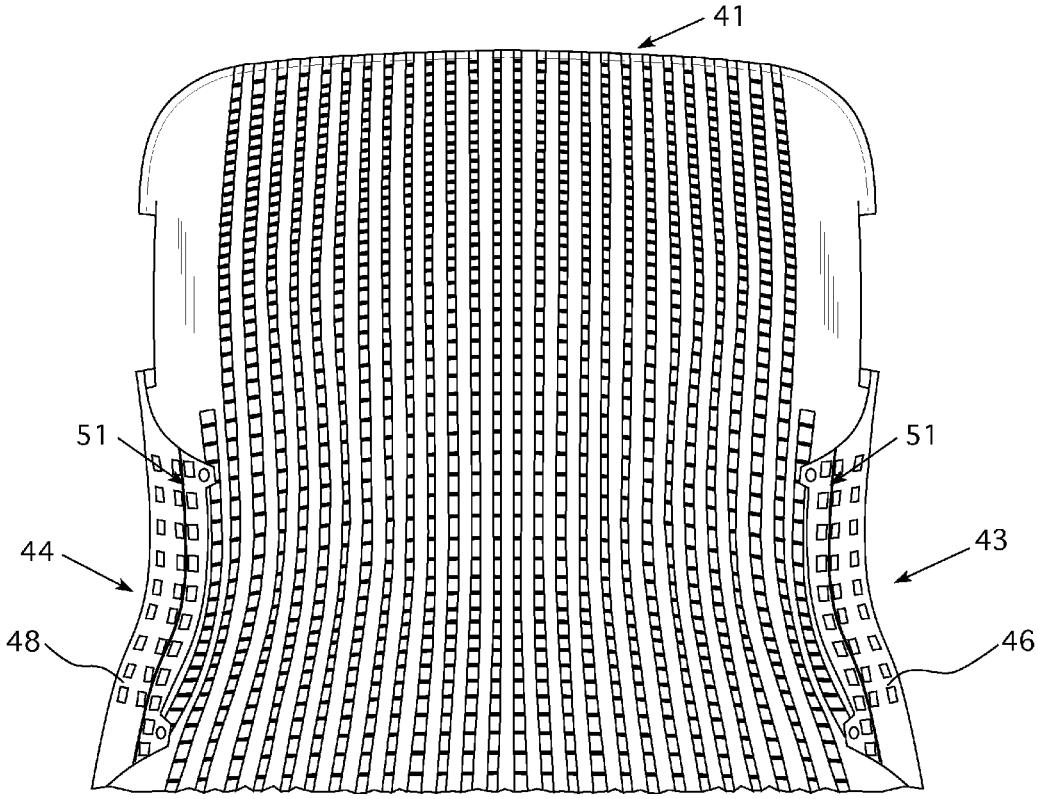
FIG. 4 is a fragmentary view of the top portion of a present preferred chair back component.
Figure 5:
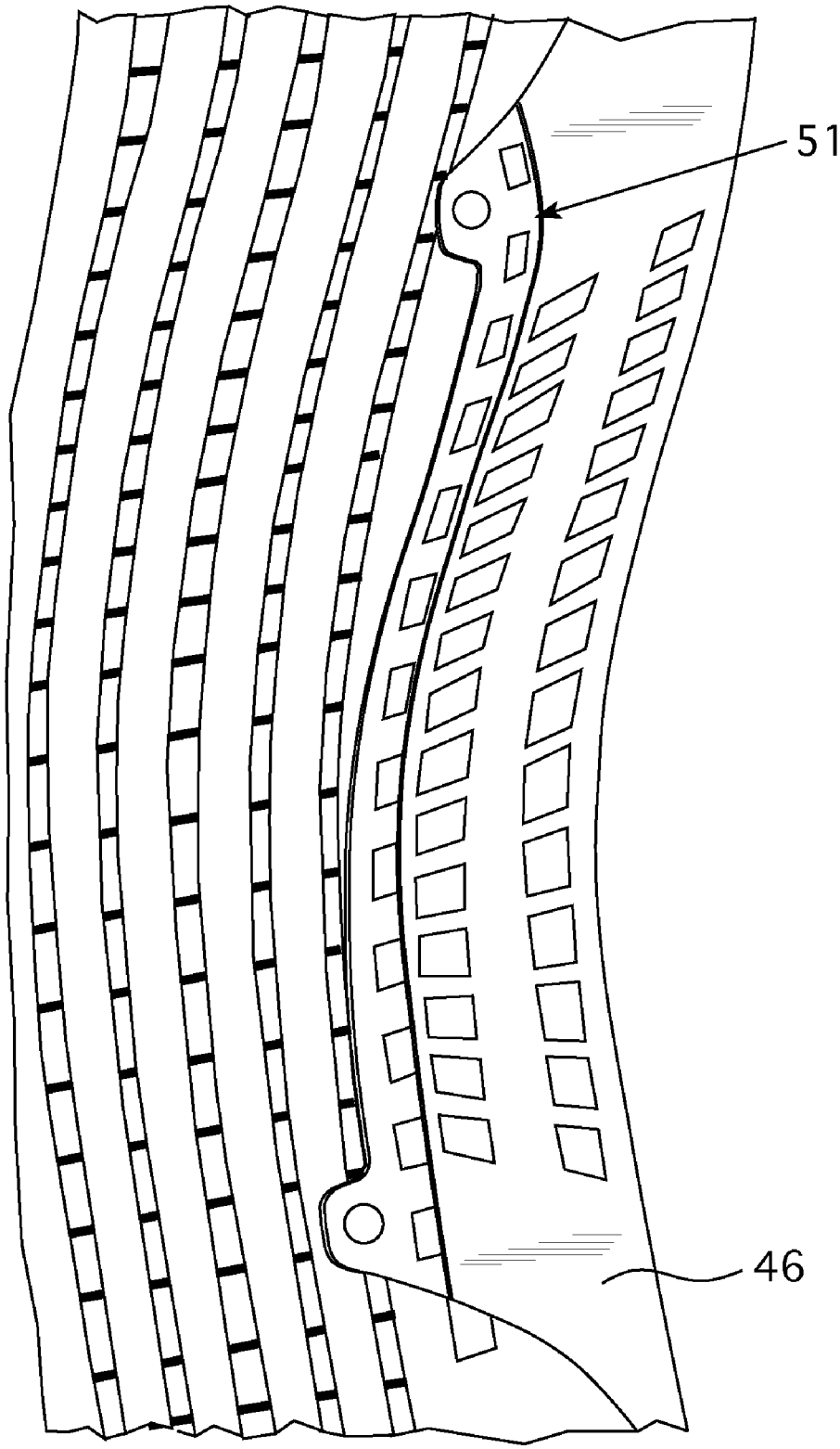
FIG. 5 is an enlarged fragmentary view of a side portion of the present preferred chair back component shown in FIG. 4.
Figure 6:
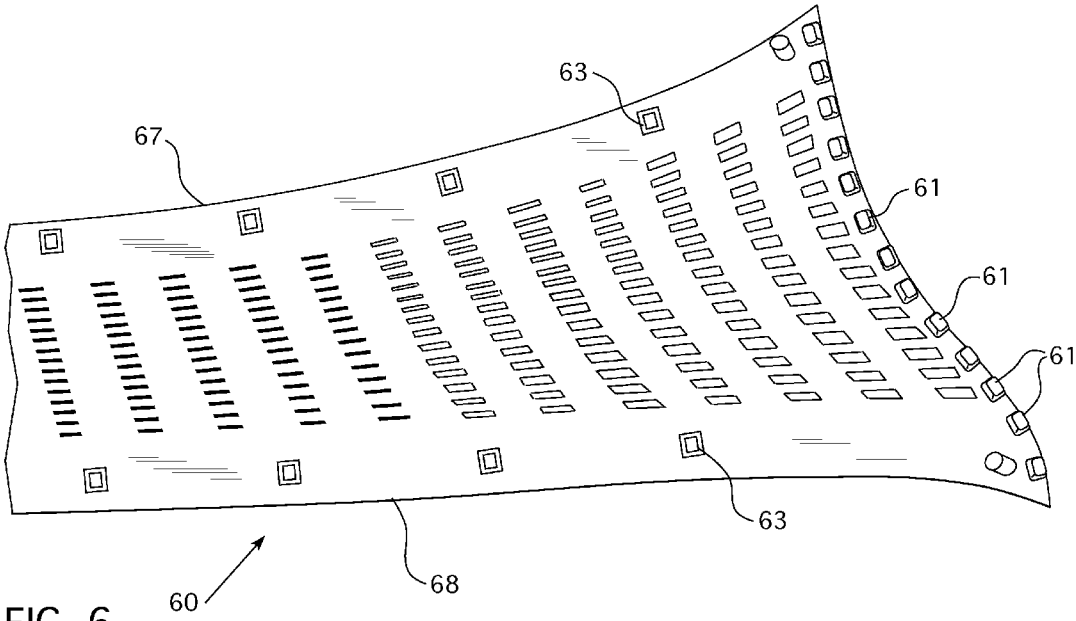
FIG. 6 is a fragmentary view of a second present preferred chair back component.

A second present preferred chair 31 is shown in FIG. 3. The chair 31 includes a back and a seat. the back skin 16 of the chair 31 is attached to a back frame 15. The armrests of the chair 31 are affixed to the back frame 15 such that the arms do not move relative to the back frame 15. A bow tie 18 is attached to a portion of the back frame and extends from a first side 20 of the back skin to the second side 22 of the back skin.

Preferably, the bow tie and back skin are composed of an elastomeric material, such as Hytrel® material made by E.I. du Pont de Nemours and Company. Of course, the back skin and bow time may also be composed of other elastomeric materials or other materials.

As may be appreciated from FIGS. 4-8, the back skin 40 may include a top 41 and side portions 43 and 44. The back skin 40 preferably does not include any fabric or woven materials. The first side 43 is opposite the second side 44. Both sides 43 and 44 extend below the top 41. The first side 43 includes a folded over portion 46 and the second side 44 also includes a folded over portion 48. Both folded over portions 46 and 48 include a connector portion 51 that has a series of apertures. The folded over portions 46 and 48 are sized to fold over a portion of the back frame to extend from the front of the back frame to the rear of the back frame for connection to the bow tie of the chair back.

The bow tie 60 includes a first end 65 and a second end opposite the first end. The bow tie 60 also has a top 67 and a bottom 68. Stakes 61 are positioned along each end. The bow tie 60 also includes projections 63 along the top and bottom of the bow tie that are sized to interlock with recesses formed in he back frame to attach the top and bottom of the bow tie 60 to the back frame.

Figure 7:
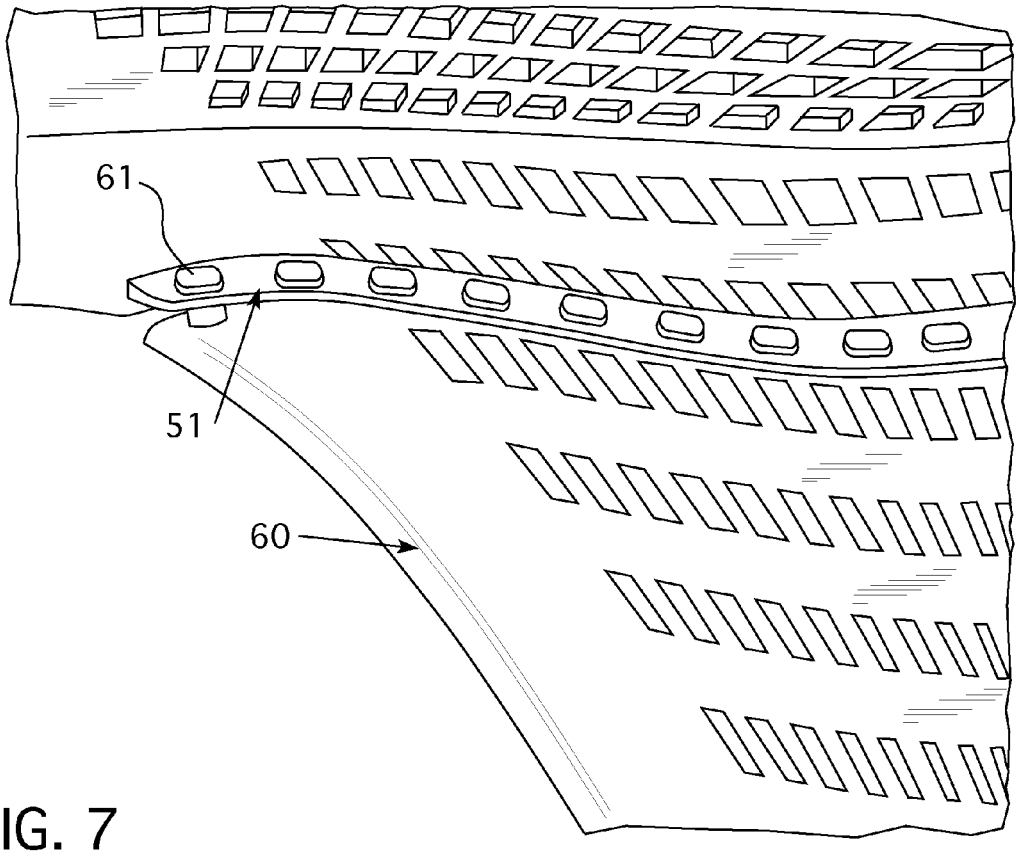
FIG. 7 is a fragmentary view of a portion of the first present preferred chair back component and a portion of the second present preferred chair back component being positioned for attachment to each other.

The stakes 61 of the bow tie 60 are sized and configured to pass through holes in the connector portion 51 of the folded portions 46 and 48 of the back skin, as may be appreciated from FIG. 7. The stakes 61 may be inserted through the holes in the connector portion 51 to attach the ends of the bow tie to the folded portions of the back skin.

For example, the back skin and bow tie may both be positioned on the back frame. Then, the ends of the bow tie may have their stakes 61 positioned through the holes of the connector portion of the back skin's folded portions, as may be appreciated from FIG. 7. After the stakes of the bow tie are positioned through the holes of the connector portions 51, the stakes may be melted or bonded to the connector portion 51. For instance, the stakes 61 may be heated by infrared light energy to bond the stakes 61 to the connector portions 51 of the back skin. Of course, other methods of heating may be used such as baking, infrared radiation, applying heat by a heat gun or laser, or other heat application methods. Such component attachment permits the back skin and bow tie to appear to seamlessly attach, which provides a preferred aesthetic effect.

Figure 9:
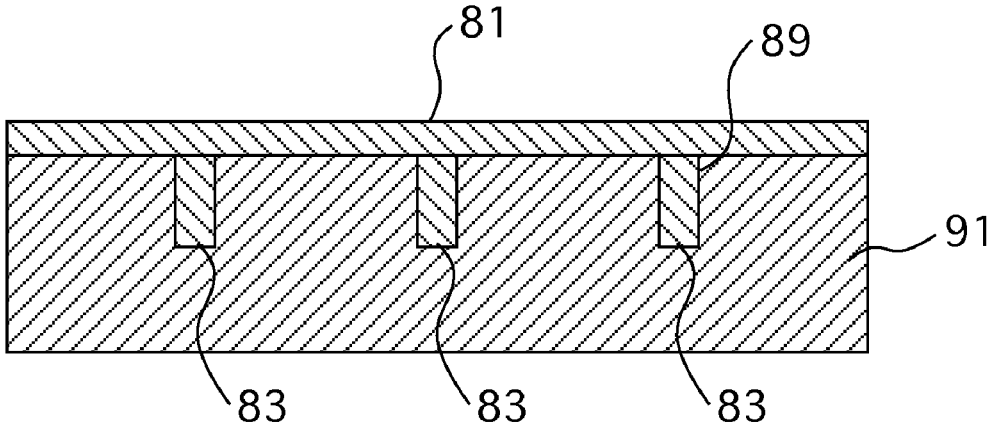
FIG. 9 is a cross sectional view showing a present preferred skin component attached to a present preferred frame component. The frame component may be a back frame, a seat frame, a portion of a seat frame, a portion of a back frame, or an armrest pad support, the skin component may be a seat skin, a back skin, or an arm pad covering or arm pad cushion element.

FIG. 9 shows a skin element 81, such as a seat skin, back skin, or arm pad cover that includes projections 83. The projections are positioned in holes 89 formed in a frame element 91. The frame element 91 may be composed of polybutylene terephthalate (PBT) and the skin element may be composed of an elastomeric material such as Hytrel material. The frame element may be tubular or have cavities adjacent to the holes 89 for receiving a portion of the projections 83. Infrared radiation or infrared light energy may be applied to the projections 83 to bond the skin element 81 to the frame element 91. The frame element may already be attached to other furniture components or chair components prior to the heating of the projections 83 or may be attached to other furniture components after the heating of the projections 83.

Preferably, the frame element is harder than the skin element. For instance, a comparison of durometer measurements may be used to show that the frame element is harder than the skin element. As another example, a hardness test may show that the frame element is harder than the skin element.

It should be understood that the skin element may be a back cover, a back skin, a mesh back support, a seat skin, a seat cover, or other structure that provides a surface for supporting a portion of a seated user's body. The frame element may be a component of a frame such as a seat frame, back frame, armrest support structure or may be a component of some other structure that provides at least some support to the skin element it is attached to.

It should be understood that the use of the stakes and openings, or projections and openings in corresponding components as discussed above can permit an aesthetically desirable attachment of soft portions of elastomeric components. Therefore, a chair design may utilize soft or very flexible elastomeric components without requiring harder plastic or metal components to help attach elastomeric components together. Such design flexibility permits more design options to be considered and can permit more aesthetically desirable chair designs to be efficiently manufactured. The soft elastomeric components may include back skin or back frame components, seat skin or seat frame components, or other seat or chair components. It should be appreciated that components may be considered "soft" if those component have a durometer measurement of at or below a durometer value of 40, or a durometer value of not greater than 40.

Of course, components being attached as described above may be composed of other materials as well, such as, for example, plastic. Further the use of heating via infrared radiation or infrared light energy may permit the attachment of such components to occur at many different steps in an assembly process, which may provide assembly design flexibility that permits improved costs savings for manufacturing furniture components or furniture, such as chairs.

While certain present certain present preferred chairs and methods of attaching chair components have been discussed and illustrated herein, it is to be distinctly understood that the invention is not limited thereto but may be otherwise variously embodied and practiced within the scope of the following claims.

What is claimed is:

1. A chair comprising:

a base;

a frame connected to the base;

a skin adjacent to the frame;

a first member, the first member comprising a first set of projections; the first member attached to a portion of the frame by insertion of the first set of projections within apertures formed in the frame and then heating the first set of projections via infrared energy to bond the first member to the frame; and wherein the first member is comprised of a second set of projections and the skin is attached to the first member via an application of infrared energy to the second set of projections to bond the skin to the first member.

2. The chair of claim 1 wherein the first member is positioned adjacent to a rear of the frame and wherein the frame is a back frame.

3. The chair of claim 1 wherein the second set of projections are inserted through holes defined in the skin prior to the application of infrared energy to the second set of projections to bond the skin to the first member.

4. The chair of claim 1 wherein the base is comprised of a seat attached to a pedestal and the frame is a back frame.

5. The chair of claim 4 wherein the back frame is comprised of a material selected from the group consisting of polymeric material, elastomeric material and plastic.

6. The chair of claim 1 wherein the skin is comprised of a polymeric material and the frame is comprised of a material that is not harder than the skin and wherein the skin is not comprised of woven materials or fabric.

7. The chair of claim 1 wherein the skin defines a plurality of apertures that are longitudinally elongated.

8. The chair of claim 1 wherein the skin has a durometer measurement not greater than 40 and the first member has a durometer measurement not greater than 40.

9. The chair of claim 1 wherein the frame is a back frame and the first member is a cross member positioned adjacent to a rear side of the back frame.

* * * * *